US005727968A

United States Patent [19]

Ito

[11] Patent Number: 5,727,968

[45] Date of Patent: Mar. 17, 1998

[54] CONNECTOR FOR FLAT CABLES

[75] Inventor: Tomonari Ito, Yokkaichi, Japan

[73] Assignee: Sumitomo Wiring Systems, Ltd., Japan

[21] Appl. No.: 625,921

[22] Filed: Apr. 1, 1996

[30] Foreign Application Priority Data

May 9, 1995 [JP] Japan ..... 7-136199

[51] Int. Cl.[6] ..... H01R 9/07

[52] U.S. Cl. ..... 439/495

[58] Field of Search ..... 439/495, 260, 439/67, 77, 492, 493, 499, 329, 497, 660, 667

[56] References Cited

U.S. PATENT DOCUMENTS

| | | | |
|---|---|---|---|
| 4,629,271 | 12/1986 | Awano | 439/495 |
| 4,778,403 | 10/1988 | Ikesugi et al. | 439/499 |
| 4,969,840 | 11/1990 | Li et al. | 439/495 |

FOREIGN PATENT DOCUMENTS

| | | | |
|---|---|---|---|
| 3093178 | 4/1991 | Japan | 439/492 |
| 7326439 | 12/1995 | Japan . | |

*Primary Examiner*—Gary F. Paumen
*Assistant Examiner*—Tho D. Ta
*Attorney, Agent, or Firm*—Jordan B. Bierman; Bierman, Muserlian and Lucas

[57] ABSTRACT

A connector for a flat cable made up of a plurality of electrically conductive wires located side-by-side. The connector is provided with a receiving chamber within which electrodes intended to be connected to the cable are located. Additional contacts are located on one of the internal walls of the receiving chamber. A generally planar retainer enters into a second space between the electrodes and the wall of the receiving chamber remote from the contacts. The retainer is provided with a rib which extends into a first space between the conductors and the contacts. The retainer is partially inserted into the first space and the leading end of the cable is thereafter introduced. The rib guides the leading end into the first space and prevents it from entering the second space. The flat cable is provided with two groups of conductive wires, spaced laterally from each other. The cable is folded longitudinally so that one of the groups is on each side, thereby permitting an increase in the number of conductive wires without a corresponding increase in the width of the cable or the size of the connector.

11 Claims, 3 Drawing Sheets

CONNECTOR FOR FLAT CABLES

The present Invention relates to a connector for flat cables, more particularly, to such a connector for connecting the ends of the flat cable to other electrical contacts.

BACKGROUND OF THE INVENTION

A prior art connector is shown in FIG. 4. Housing 1, with a slit opening, has a plurality of electrodes 3 on one inner peripheral surface 2. Retainer 4, in thin plate form and wedge-shaped in cross section, can be inserted into housing 1. Flat cable 5 is formed by securing a plurality of electrically conductive wires in a film. At the leading end, one surface of the wire is exposed by peeling off the film.

With the exposed wire facing electrodes 3, flat cable 5 is inserted into housing 1, and retainer 4 is inserted on the surface away from flat cable 5. Then, as wedge-shaped retainer 4 is pushed in, flat cable 5 is pressed against electrode 3 and electrically connected under a predetermined contact pressure.

In the conventional connector described above, electrode 3 faces only one surface of flat cable 5, and the number of wires therein is limited by the width thereof. To increase the number of wires, the width of the flat cable 5 has to be increased.

SUMMARY OF THE INVENTION

It is the object of the present Invention to provide a connector for flat cable wherein the number of wires can be increased without broadening thereof.

The present Invention comprises a connector which includes a receiving chamber having a floor and a ceiling. At least one electrode, intended to be electrically connected to the flat cable, is located in the chamber between the floor and the ceiling. There is at least one contact for electrical connection to the cable on the floor, there being a first space between the electrode and the floor and a second space between the electrode and the ceiling. The leading end of the cable is inserted into the first space.

A retainer is provided, having a generally planar configuration, which is introduced into the second space. The retainer carries a rib which is perpendicular to its plane and extends toward the floor. This rib, when the retainer is partly introduced into the chamber, contacts the leading end of the cable and deflects it into the first space. In this way, the cable is prevented from entering into the second space between the electrode and the ceiling.

In a preferred form of the device, the cable comprises a first group of wires and a second group of wires. The two groups are located side-by-side and spaced apart laterally. The flat cable is then folded longitudinally between the two groups so that one group of wires is on each side of the folded cable. Thus, one group can contact the electrode and the other group contacts the contact. Hence, the retainer bears against the electrode and presses it firmly toward the contact. The leading end of the cable is secured therebetween under a pressure which can be predetermined. In this way, the desired circuit is formed.

Since it is preferred that there be a plurality of electrodes, as well as the plurality of conductive wires, the assembly of the connector will be described with respect thereto. However, it is understood that the device is equally useful when only a single electrode is provided.

In a further modification of the Invention, a number of recesses, corresponding to the number of electrodes, is provided on the retainer. Therefore, when the retainer is inserted, the electrodes are securely held and the rib projects into the first space. This eliminates any opportunity for misassembly resulting from the leading end of the cable entering the second space rather than the first space.

Thus, in accordance with the present Invention, both surfaces of the flat cable can be used for electrical connections. As a result, compared to the single surface cable, the number of conductive wires can be substantially increased without any increase in width. At the same time, entry of the cable into the wrong space is prevented by the design of the retainer.

BRIEF DESCRIPTION OF THE DRAWINGS

In the accompanying drawings, constituting a part hereof and in which like reference characters indicate like parts.

DETAILED DESCRIPTION OF THE INVENTION

The inventive connector comprises housing 10 having receiving chamber 11 defined by floor 11*a* and ceiling 11*b*. Contact 12 is located on floor 11*a* and faces electrodes 13. Chamber 11 is divided by electrodes 13 into a first space, between electrodes 13 and contacts 12, and a second space, between electrodes 13 and ceiling 11*b*.

Figure 1:
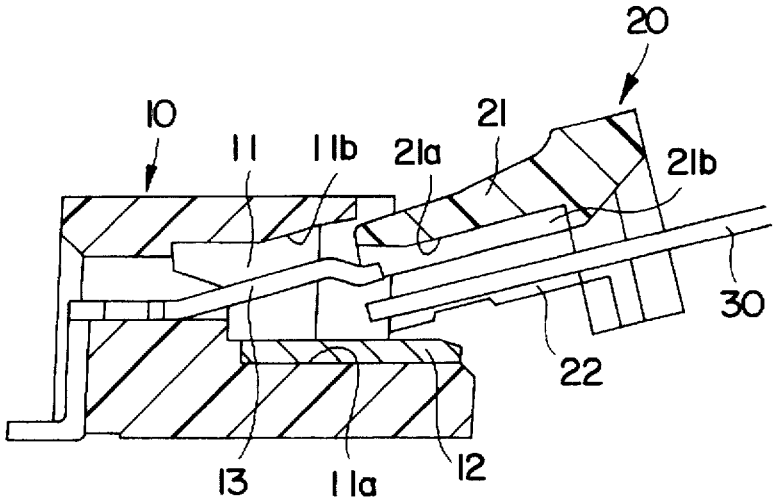
FIG. 1 is a sectional view of the connector of the present Invention with the retainer partially inserted.
Figure 2:
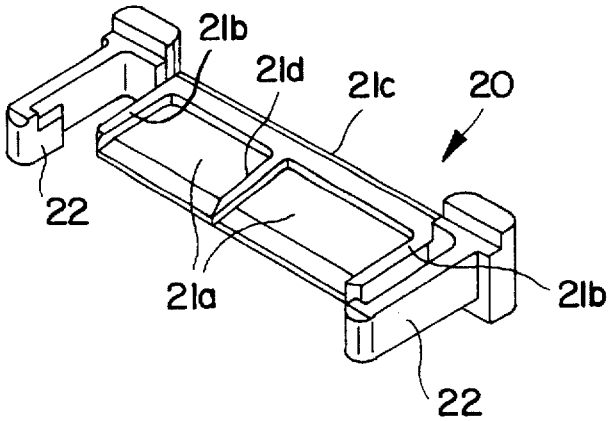
FIG. 2 is a perspective view of the bottom of the retainer.

Retainer 20 is provided with thin plate 21 having recesses 21*a*. The recesses are defined by side ridges 21*b*, rear ridge 21*c*, and rib 21*d*. Retainer 20 is also provided with locking arms 22 to stop retainer 20 at the intermediate position shown in FIG. 1.

Retainer 20 is first partially introduced into chamber 11 (see FIG. 1), thereafter the leading end of flat cable 30 is inserted into the first space between electrodes 13 and contacts 12. Rib 21*d* projects from thin plate 21. Thus, as flat cable 30 is inserted, rib 21*d* guides the leading end into the first space between electrodes 13 and contacts 12 and prevents it from entering the second space between electrodes 13 and ceiling 11*b*.

Figure 3:
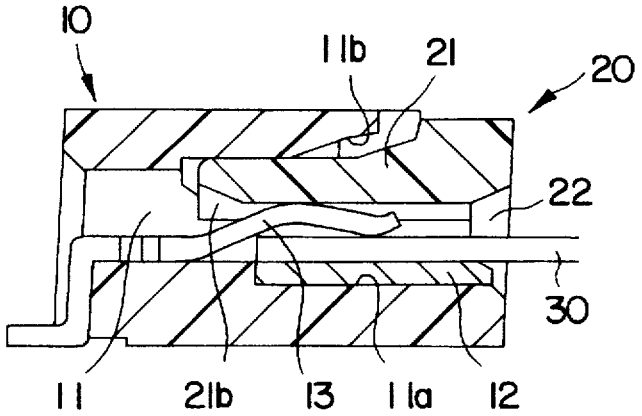
FIG. 3 is a view similar to FIG. 1 wherein the retainer is fully inserted into the connector.
Figure 4:
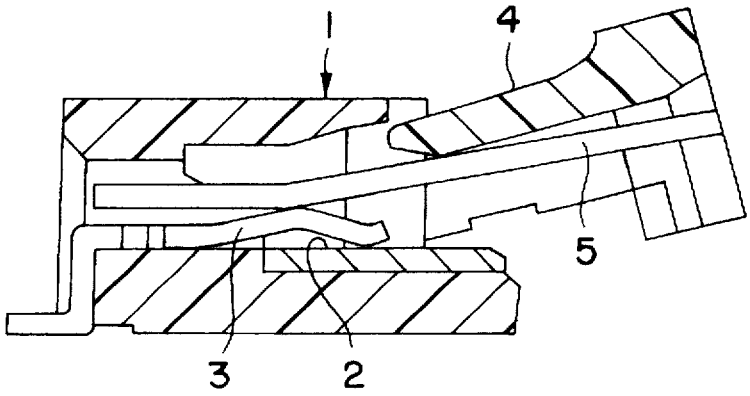
FIG. 4 PRIOR ART
FIG. 4 is a view similar to FIG. 1 of a prior art connector.

Retainer 20 is then pushed completely into receiving chamber 11 as shown in FIG. 3. Thin plate 21 of retainer 20 presses electrode 13 toward contact 12 and thereby holds cable 30 securely therebetween. Moreover, each of electrodes 13 enters into one of recesses 21*a* and rear ridge 21*c* acts as a stop therefor. As a result of the pressure on electrodes 13 exerted by thin plate 21 of retainer 20, the leading end of cable 30 is firmly gripped between electrodes 13 and contact 12.

To assemble the connector of the present Invention, the leading edge of plate 21 of retainer 20 is inserted between electrode 13 and ceiling 11. In this position, locking arms 22 abut stops on the outer lateral surface of housing 10, thereby holding retainer 20 in the position shown in FIG. 1. The leading edges of electrodes 13 are partially within recesses 21*a*, and rib 21*d* projects between electrodes 13 into the first space between electrodes 13 and contacts 12.

The leading end of cable 30 is inserted into chamber 11 beneath retainer 20. Thus, even though it is possible that the leading end of cable 30 curls upwardly or that the operator has misdirected it, rib 21*d* will deflect the end into the first space between electrodes 13 and contacts 12. Hence, cable 30 will not be incorrectly inserted into the second space between electrodes 13 and ceiling 11*b*.

After cable 30 has been inserted, retainer 20 is pushed into its fully closed position as shown in FIG. 3. As can be seen therefrom, retainer 20 exerts substantial force on electrodes 13, thereby pressing them firmly toward contacts 12. This secures cable 30 in good electrical contact between electrodes 13 and contacts 12.

Figure 5:
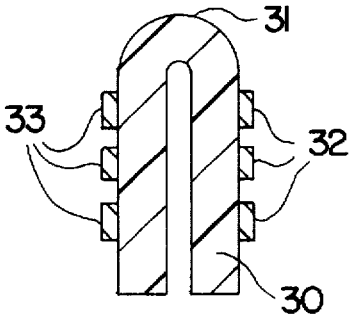
FIG. 5 is a cross section of a folded flat cable according to the invention.

As shown in FIG. 5, cable 30 is folded longitudinally at 31, thereby providing one group 32 of conductor wires which will be in contact with contact 12, and a second group 33 of conductive wires which will contact electrodes 13. This permits an increase in the number of conductive wires without increasing the width of the cable or the connector.

Although only certain embodiments of the present Invention have been expressly disclosed, it is, nonetheless, to be broadly construed and not to be limited except by the character of the claims appended hereto.

Figure 6:
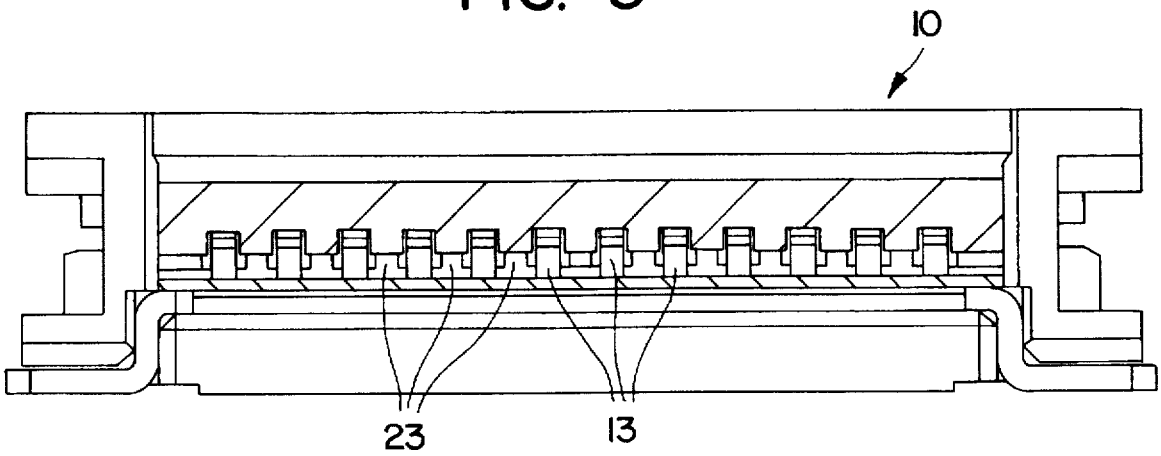
FIG. 6 is a front view of the housing of another embodiment of the invention showing a plurality view of electrodes mounted therein.
Figure 7:
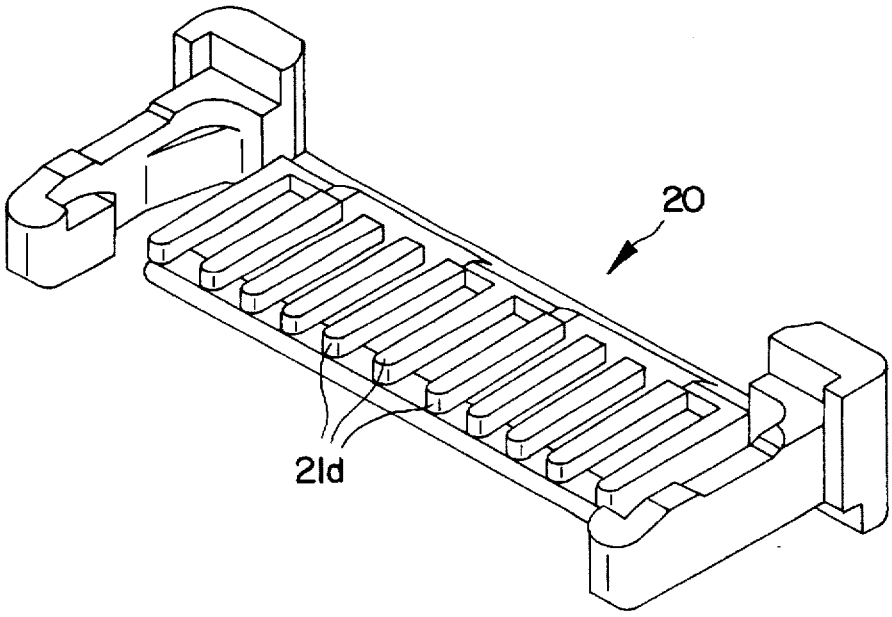
FIG. 7 is a perspective view of the retainer used in FIG. 6.

FIG. 6 is a front view of the housing of another embodiment of the invention showing a plurality of electrodes mounted therein; and FIG. 7 is a perspective view of the retainer used in FIG. 6.

What claim is:

1. A connector for a flat cable comprising a plurality of electrically conductive wires extending longitudinally of, and in side-by-side relationship across, said cable, said connector including a receiving chamber having a floor and a ceiling, at least two electrodes, in side-by-side relationship with a gap therebetween, for electrical connection to said cable, in said chamber between said floor and said ceiling, at least one contact for electrical connection to said cable on said floor, a first space between said electrode and said floor, a second space between said electrode and said ceiling, a leading end of said cable adapted to enter said first space, a retainer, comprising a generally planar thin plate for entry into said second space, at least one rib upstanding from said plate toward said floor and adapted to enter said gap when said retainer is inserted into said second space, said rib adapted to contact said leading end as it is inserted into said receiving chamber and guide said leading end into said first space, whereby said plate bears against said electrode and urges it toward said contact.

2. The connector of claim 1 wherein said flat cable comprises a first group of said wires and a second group of said wires, said first group and said second group being in a side-by-side relationship across said cable, said cable being folded longitudinally, thereby forming a crease between said first group and said second group, whereby said first group is on one side of said cable and adapted to contact said electrode, said second group is on an opposite side of said cable and adapted to contact said contact.

3. The connector of claim 1 wherein said contact is a ground.

4. The connector of claim 1 wherein said retainer carries at least one locking arm adapted to engage an exterior wall of said connector.

5. The connector of claim 1 wherein said retainer has a front edge facing said electrode and a rear edge opposite and substantially parallel thereto, an upstanding stop on said retainer adjacent said rear edge and extending toward said floor, said stop and said rib defining a receiver for said electrode.

6. The connector of claim 5 wherein said stop comprises a rear ridge extending laterally across said retainer.

7. The connector of claim 5 wherein said stop comprises a side ridge substantially perpendicular to said rear edge on either side of said retainer.

8. The connector of claim 5 wherein said front edge is tapered in a direction away from said rear edge.

9. The connector of claim 5 wherein there are at least two electrodes in side-by-side relationship with a gap therebetween, said rib adapted to enter said gap when said retainer is inserted into said second space.

10. The connector of claim 9 wherein said stop comprises a side ridge substantially perpendicular to said rear edge on either side of said retainer.

11. The connector of claim 10 wherein there are two locking arms, one on each exterior wall of said connector.

* * * * *